US011085145B2

(12) United States Patent
Halawani

(10) Patent No.: US 11,085,145 B2
(45) Date of Patent: Aug. 10, 2021

(54) STEAM HANGER

(71) Applicant: Hadi Halawani, West Hollywood, CA (US)

(72) Inventor: Hadi Halawani, West Hollywood, CA (US)

( * ) Notice: Subject to any disclaimer, the term of this patent is extended or adjusted under 35 U.S.C. 154(b) by 168 days.

(21) Appl. No.: 16/506,564

(22) Filed: Jul. 9, 2019

(65) Prior Publication Data

US 2020/0040516 A1 Feb. 6, 2020

Related U.S. Application Data

(60) Provisional application No. 62/714,692, filed on Aug. 4, 2018.

(51) Int. Cl.
*D06F 73/00* (2006.01)
*A47G 25/40* (2006.01)

(52) U.S. Cl.
CPC ..... *D06F 73/00* (2013.01); *A47G 25/40* (2013.01); *A47G 25/4053* (2013.01)

(58) Field of Classification Search
CPC ..... D06F 73/00; D06F 59/00; D06F 59/02; A47G 25/14; A47G 25/1485; A47G 25/1492; A47G 25/16; A47G 25/20; A47G 25/22; A47G 25/28–32; A47G 25/40; A47G 25/4046; A47G 25/4053; A47G 25/44; A47G 25/441–443
See application file for complete search history.

(56) References Cited

U.S. PATENT DOCUMENTS 1,659,097 A * 2/1928 Gygi ..... D06F 73/00 223/70
2,969,897 A * 1/1961 Paris ..... D06F 71/34 223/67
3,148,808 A * 9/1964 Griffin ..... A47G 25/60 223/86
3,733,723 A * 5/1973 Takakuwa ..... D06F 75/30 38/69
5,687,278 A * 11/1997 Turner ..... D06F 73/00 219/211

(Continued)

FOREIGN PATENT DOCUMENTS

CN 204266018 U * 4/2015

*Primary Examiner* — Ismael Izaguirre
(74) *Attorney, Agent, or Firm* — Dhiraj Jindal; Patent Yogi LLC

(57) ABSTRACT

According to some embodiments, a steam hanger is disclosed. Further, the steam hanger may include a main body which may include a plurality of steam apertures configured to release steam. Further, the main body may include at least one fill spout which may include an opening to a water reservoir. Further, the main body may include a foldable hook attached to a top surface of the main body. Further, the steam hanger may include a heating element located inside the water reservoir to heat the water in the water reservoir to generate the steam. Further, the steam hanger may include an energy storage device electrically coupled with the heating element to provide electrical power to the heating element. Further, the steam hanger may include a plurality of retractable ducts retractably attached to the at least one surface of the main body to convey the steam outward for large sized clothing.

17 Claims, 11 Drawing Sheets

(56) References Cited

U.S. PATENT DOCUMENTS

| | | | | |
|---|---|---|---|---|
| 6,675,997 | B1 * | 1/2004 | Gouldson | A47G 25/18 223/89 |
| D616,621 | S * | 5/2010 | Prokop | D32/58 |
| 8,950,031 | B1 * | 2/2015 | Jaramillo | D06F 87/00 8/149.3 |
| 9,765,474 | B1 * | 9/2017 | Bergman | D06F 73/00 |
| 2013/0193171 | A1 * | 8/2013 | Carter | D06F 71/34 223/51 |
| 2017/0145623 | A1 * | 5/2017 | Jung | D06F 58/203 |

* cited by examiner

STEAM HANGER

RELATED APPLICATION(S)

Under provisions of 35 U.S.C. § 119 e, the Applicant(s) claim the benefit of U.S. provisional application No. 62/714,692 filed on Aug. 4, 2018, which is incorporated herein by reference.

FIELD OF THE INVENTION

The disclosure relates generally to a cloth caring equipment, and in particular to a steam hanger.

BACKGROUND OF THE INVENTION

When traveling or engaged in a long day at the office, maintaining the freshly pressed appearance of shirts and other clothing can be a challenge. Most hotels offer steam irons and ironing boards for use by guests, but using them is time-consuming. A device which can restore the freshly pressed appearance of clothing while unattended by the user would be useful and would be well received.

Therefore, there is a need for an improved steam hanger that may overcome one or more of the above-mentioned problems and/or limitations.

SUMMARY

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

According to some embodiments, a steam hanger is disclosed. Further, the steam hanger may include a main body having a substantially cuboid shape configured to support clothing. Further, at least one surface of the main body may include a plurality of steam apertures configured to release steam. Further, the main body may include at least one fill spout. Further, the at least one fill spout may include an opening to a water reservoir. Further, the at least one fill spout may be configured to fill, and drain the water reservoir. Further, the main body may include a foldable hook attached to a top surface of the main body configured to suspend the steam hanger from a suspension point.

Further, the steam hanger may include the water reservoir. The water reservoir may include a flexible cylindrical tank located inside the main body. Further, the flexible cylindrical tank may be configured to store water.

Further, the steam hanger may include a heating element located inside the water reservoir configured to heat the water in the water reservoir to generate the steam.

Further, the steam hanger may include an energy storage device electrically coupled with the heating element through a controller. Further, the energy storage device may be configured to provide electrical power to the heating element.

Further, the steam hanger may include a plurality of retractable ducts retractably attached to the at least one surface of the main body. Further, the plurality of retractable ducts may be configured to extend in at least one direction to convey the steam outward for large sized clothing.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
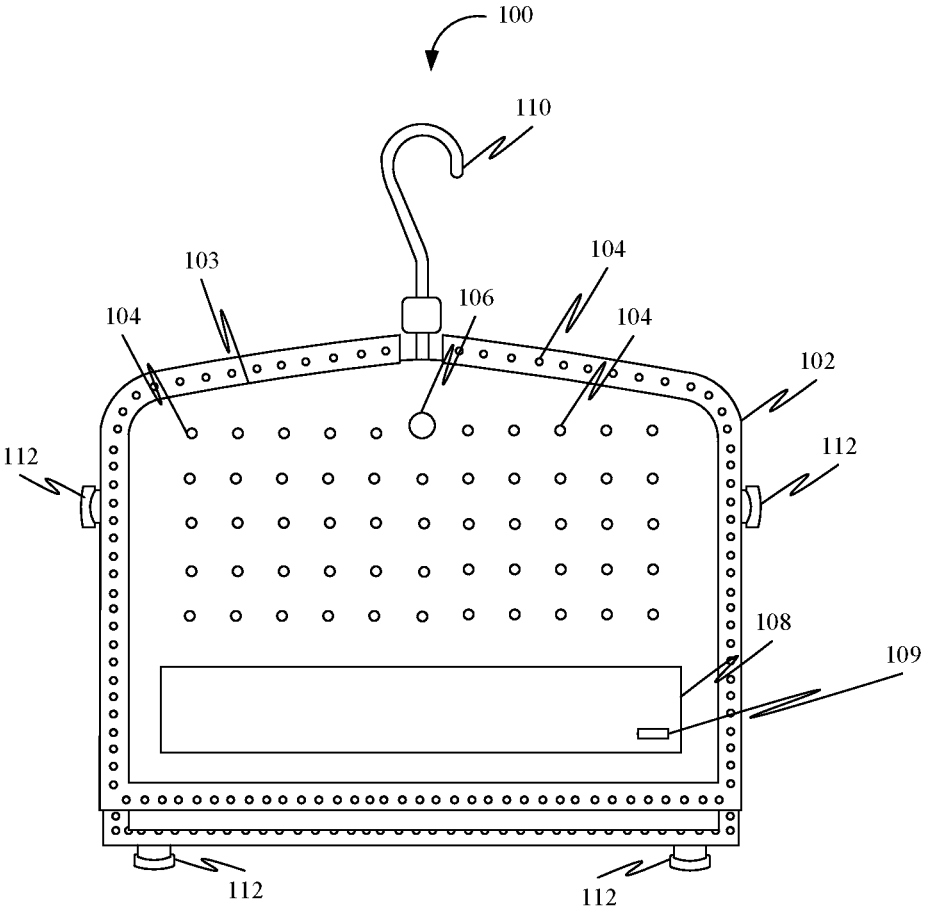
FIG. 1 is a front view of a steam hanger, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items. "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a steam hanger, embodiments of the present disclosure are not limited to use only in this context.

FIG. 1 is a front view of a steam hanger 100, in accordance with some embodiments. Further, the steam hanger 100 may include a main body 102 having a substantially cuboid shape configured to support clothing. Further, at least one surface of the main body 102 may include a plurality of steam apertures 104 configured to release steam. Further, the main body 102 may include at least one fill spout 106. Further, the at least one fill spout 106 may include an opening to a water reservoir. Further, the at least one fill spout 106 may be configured to fill, and drain the water reservoir. Further, in some embodiments, the at least one fill spout 106 may be located at a top center of a rear surface of the main body 102. Further, the main body 102 may include a foldable hook 110 attached to a top surface of the main body 102 configured to suspend the steam hanger 100 from a suspension point. Further, in some embodiments, the foldable hook 110 may be attached to the top surface through a rotating clamp 118. Further, the rotating clamp 118 may be configured to be rotated in order to fold the foldable hook.

Further, the steam hanger 100 may include the water reservoir. The water reservoir may include a flexible cylindrical tank located inside the main body 102. Further, the flexible cylindrical tank may be configured to store water. Further, in some embodiments, the water reservoir may be configured to be collapsed in an accordion-like manner.

Further, the steam hanger 100 may include a heating element located inside the water reservoir configured to heat the water in the water reservoir to generate the steam.

Further, the steam hanger 100 may include an energy storage device 108 electrically coupled with the heating element through a controller. Further, in some embodiments, the controller may be configured to allow the flow of electrical energy from the energy storage device 108 to the heating element for a predetermined period. Further, the predetermined period may include at least one of 2 minutes, 3 minutes, and 15 minutes. Further, at least one of the energy storage device 108 and the controller may be secured within the main body 102. Further, the energy storage device 108 may be configured to provide electrical power to the heating element. Further, in some embodiments, the energy storage device 108 may include a battery such as, but not limited to, at least one of a Lithium-ion battery, a Nickel-Cadmium battery, a Lead-Acid battery, and a Nickel-Metal hydride battery. Further, in some embodiments, the energy storage device 108 may be removed securely within the main body 102.

Further, the steam hanger 100 may include a plurality of retractable ducts 114 retractably attached to the at least one surface of the main body 102. Further, the plurality of retractable ducts 114 may be configured to extend in at least one direction to convey the steam outward for large sized clothing. Further, in some embodiments, each retractable duct in the plurality of retractable ducts 114 may include a removable endcap 112. Further, the removable endcap 112 may be configured to allow the steam to be quickly vented when the removable endcap 112 may be removed from the retractable duct. Further, in some embodiments, two retractable ducts of the plurality of retractable ducts 114 may be located on side surfaces near an upper corner of the main body 102. Further, the two retractable ducts may be configured to extend laterally. Further, in some embodiments, two retractable ducts of the plurality of retractable ducts 114 may be located on a bottom surface near a lower corner of the main body 102. Further, the two retractable ducts may be configured to extend downward. Further, in some embodiments, at least one of the removable endcap 112, and the water reservoir may be manufactured using at least one of a plastic, and a rubber.

Further, in some embodiments, the steam hanger 100 may include a retractable extension 116. Further, the retractable extension 116 may be a cuboid section substantially equal in size to the main body 102. Further, each surface of the retractable extension 116 may include the plurality of steam apertures 104. Further, in some embodiments, the retractable extension 116 may be configured to be engaged with a bottom surface of the main body 102. Further, the retractable extension 116 may be extended from the bottom surface for distributing the steam to lower extremities of large sized clothing. Further, in some embodiments, at least one of the main body 102, the foldable hook, the plurality of ducts, and the retractable extension 116 may be manufactured using at least one of a stainless steel, and an aluminum alloy.

Figure 2:
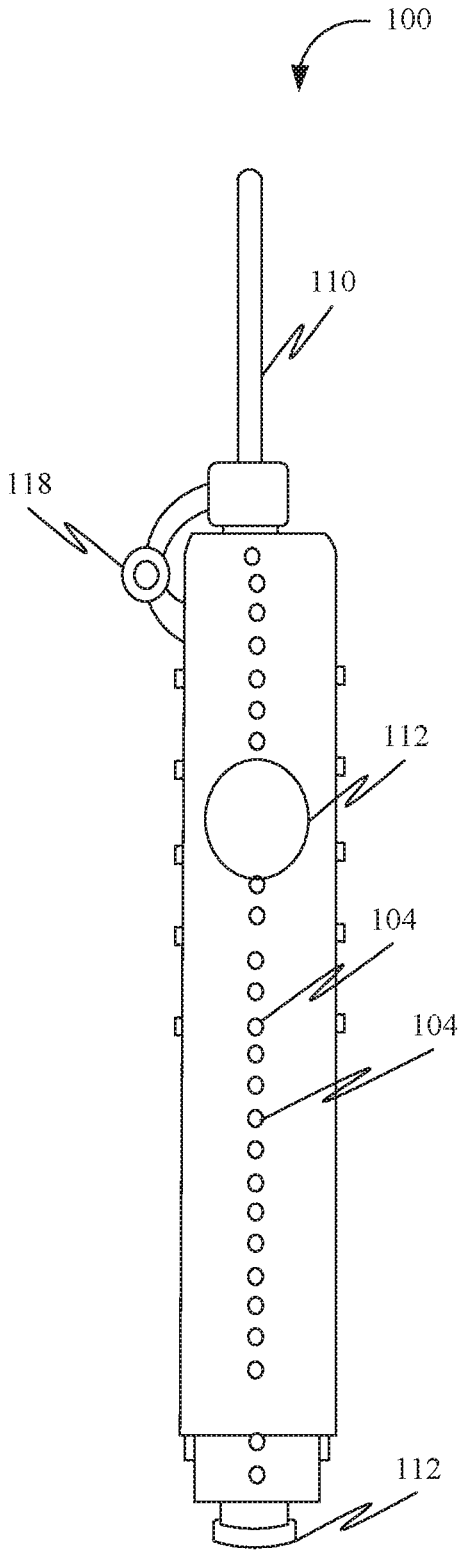
FIG. 2 is a left side view of a steam hanger, in accordance with some embodiments.
Figure 3:
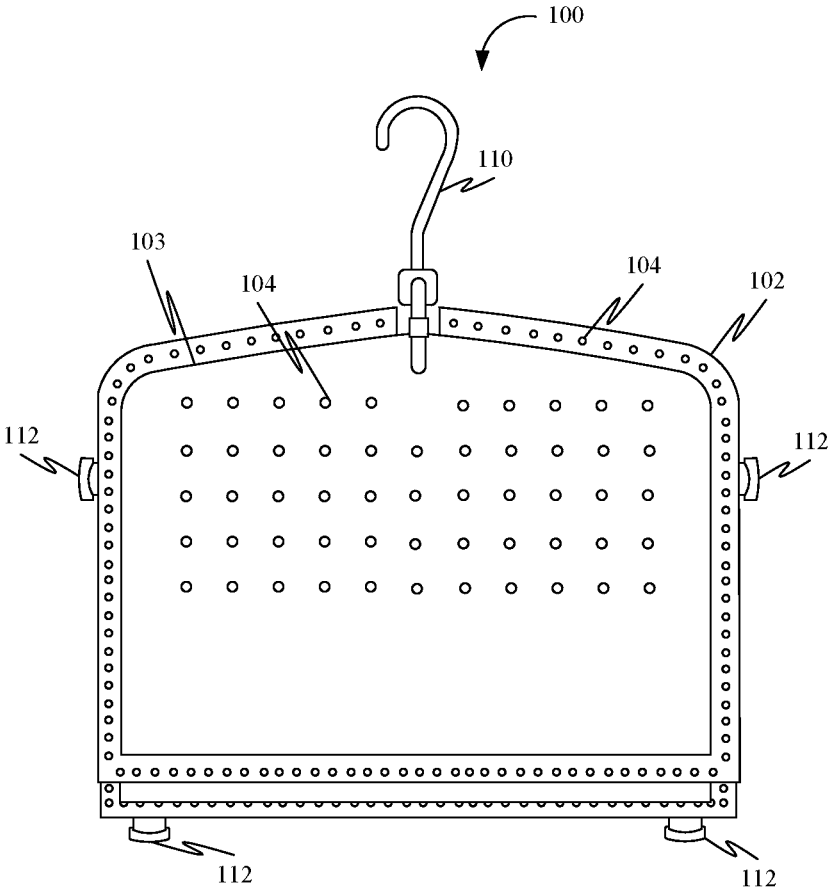
FIG. 3 is a rear view of a steam hanger, in accordance with some embodiments.
Figure 4:
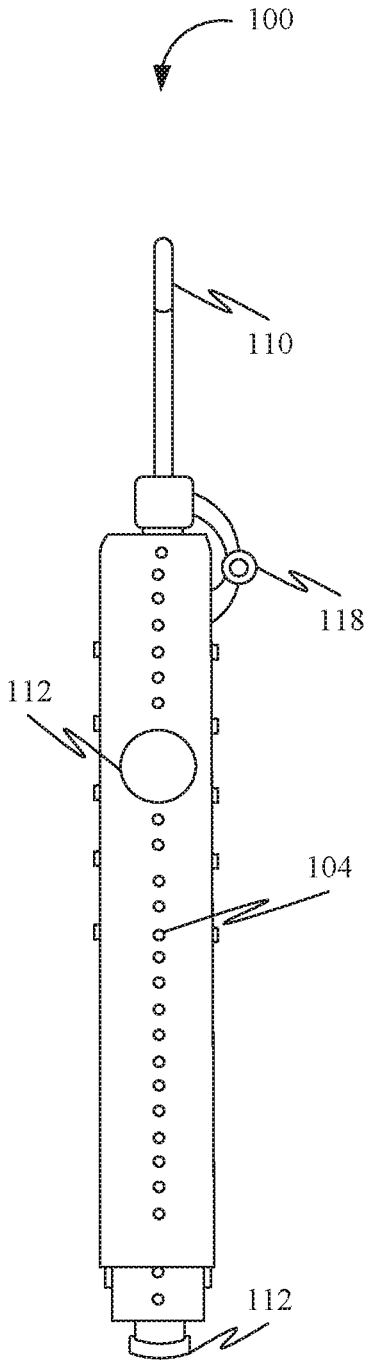
FIG. 4 is a right side view of a steam hanger, in accordance with some embodiments.
Figure 5:
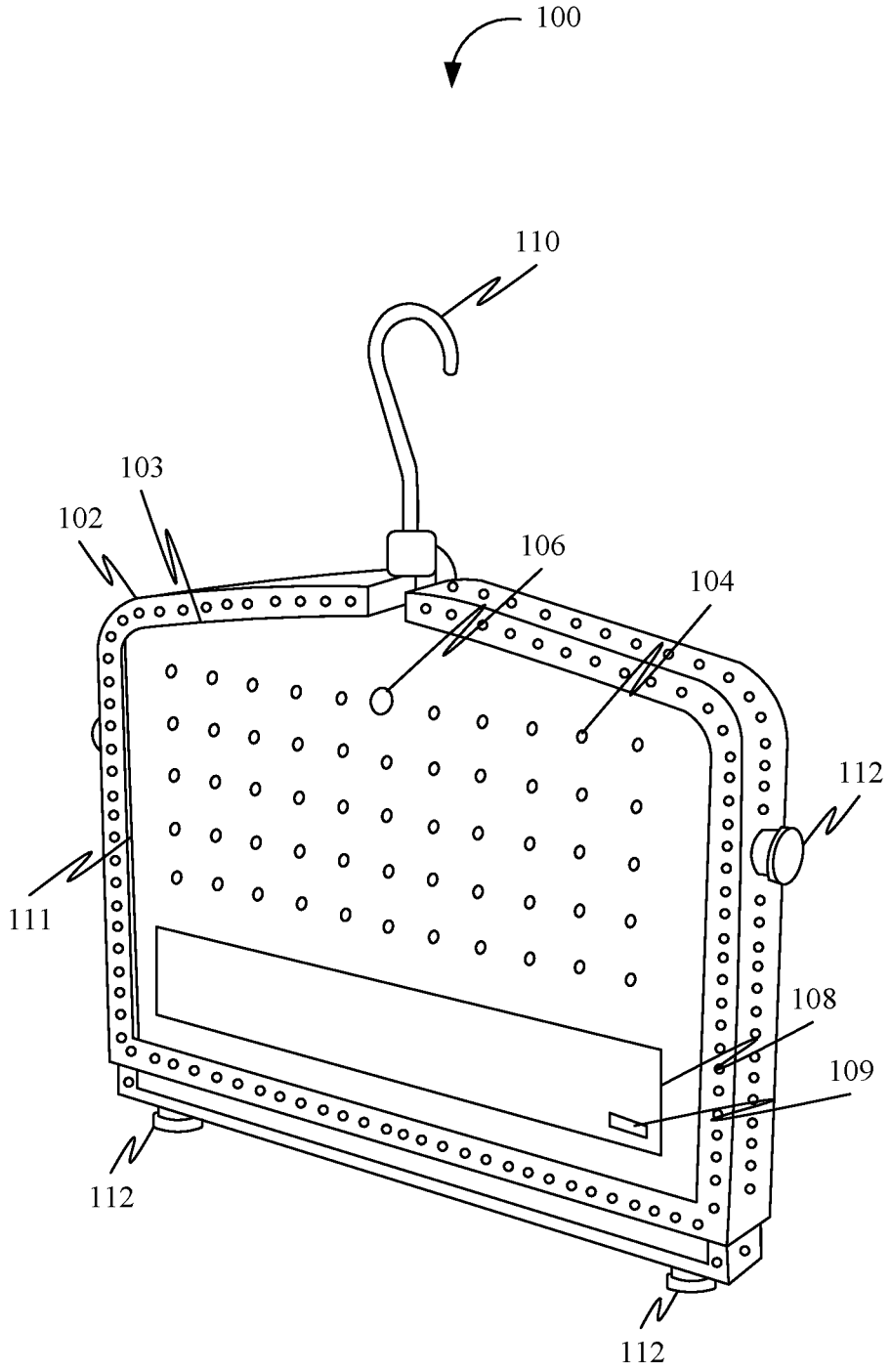
FIG. 5 is a front top perspective view of a steam hanger, in accordance with some embodiments.
Figure 6:
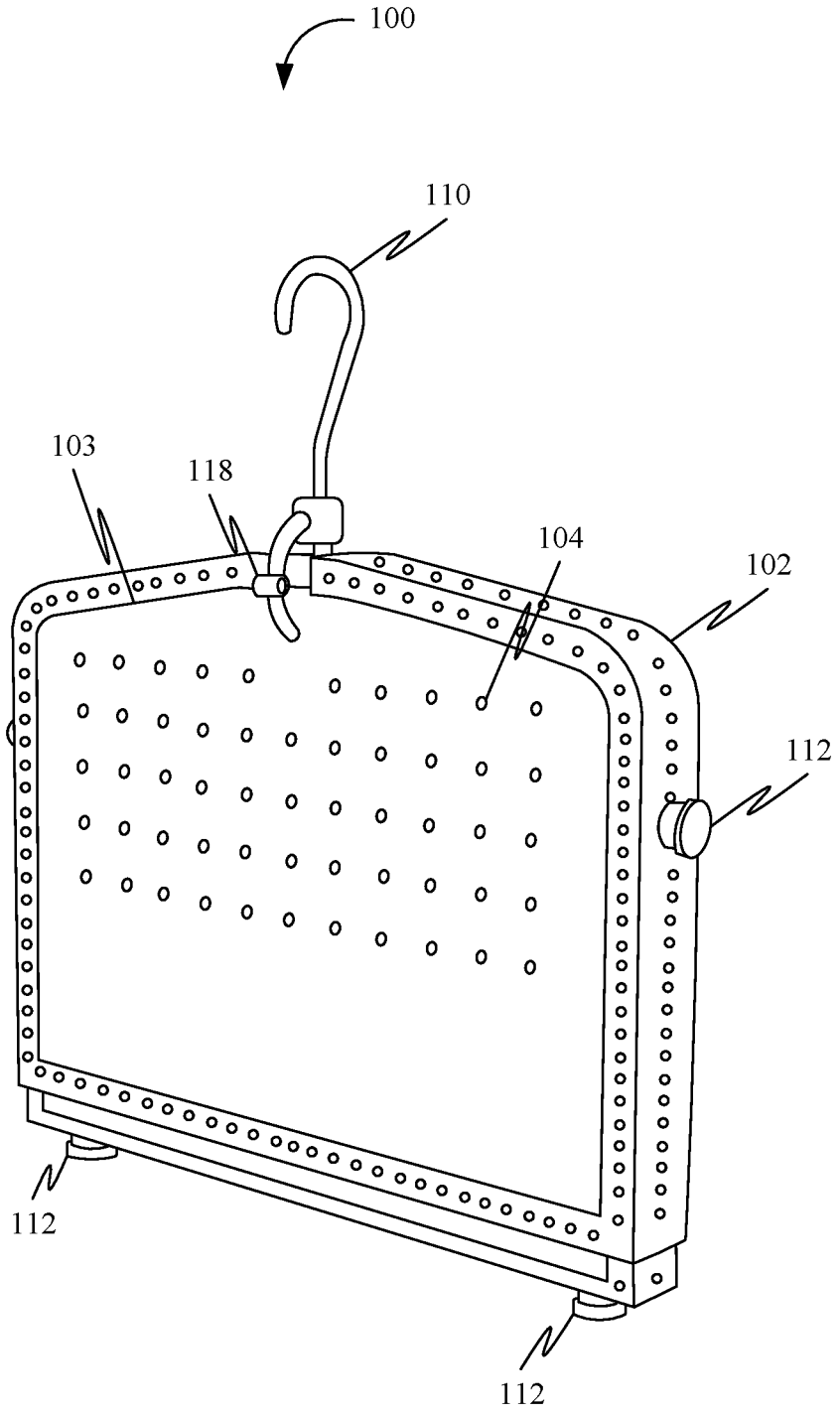
FIG. 6 is a rear top perspective view of a steam hanger, in accordance with some embodiments.
Figure 7:
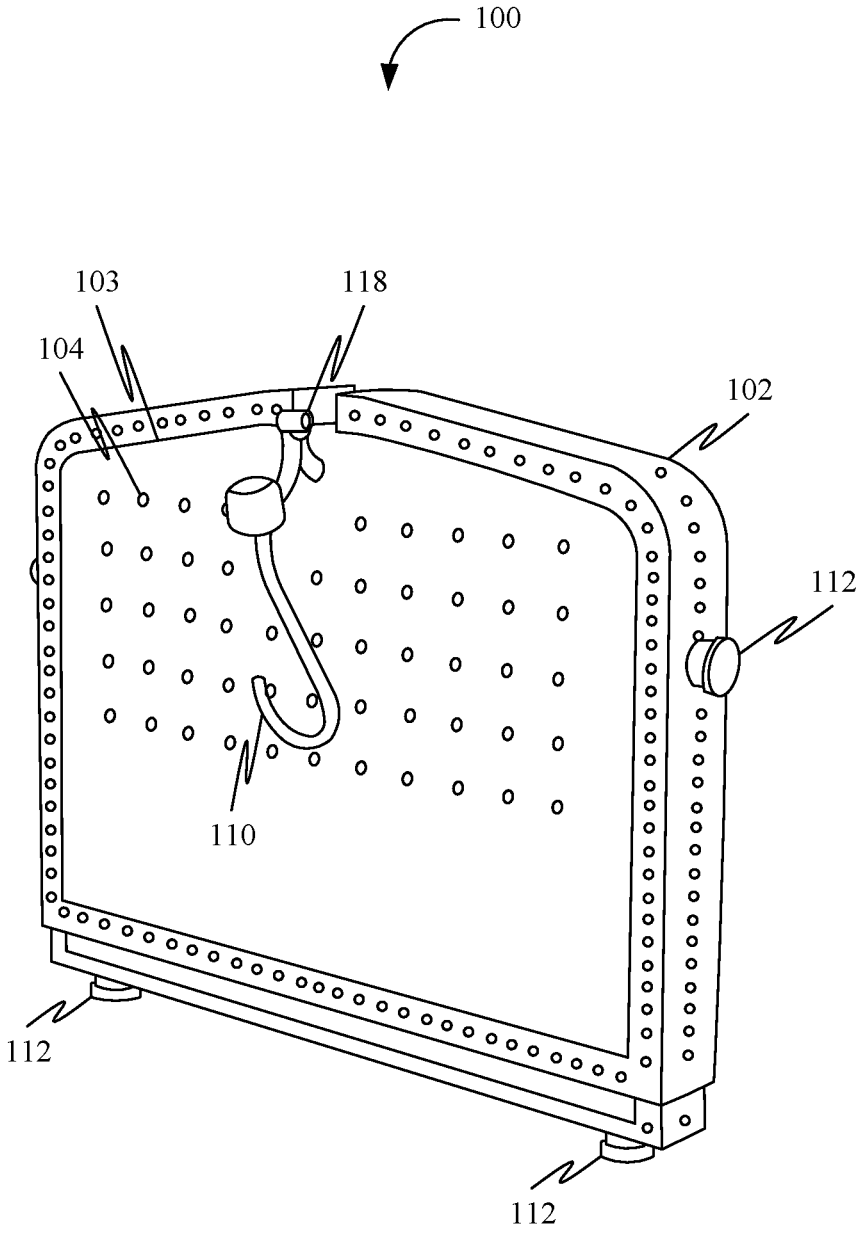
FIG. 7 is a rear top perspective view of a steam hanger with a foldable hook in a folded configuration, in accordance with some embodiments.
Figure 8:
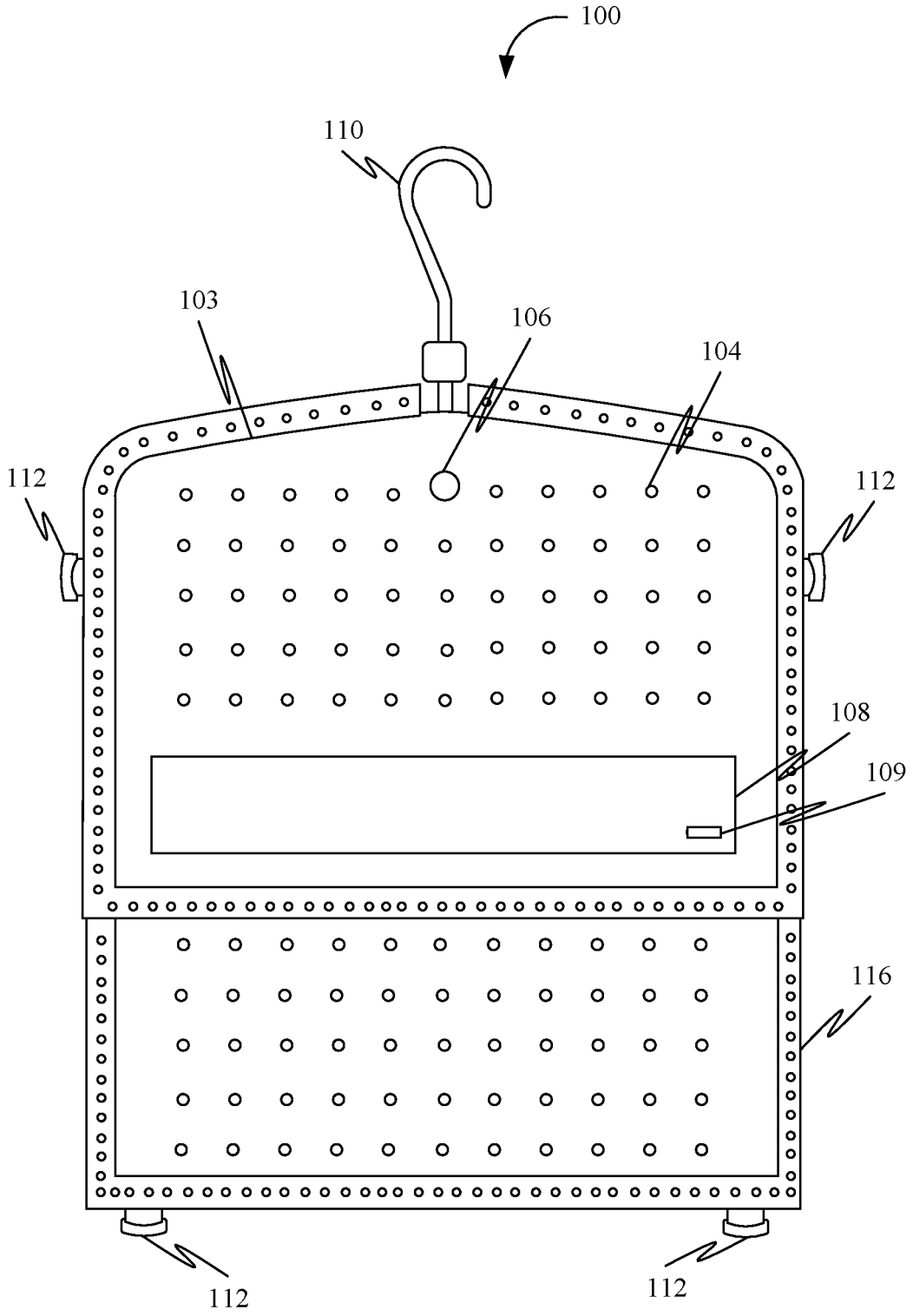
FIG. 8 is a front view of a steam hanger with a retracting extension in an extended configuration, in accordance with some embodiments.
Figure 9:
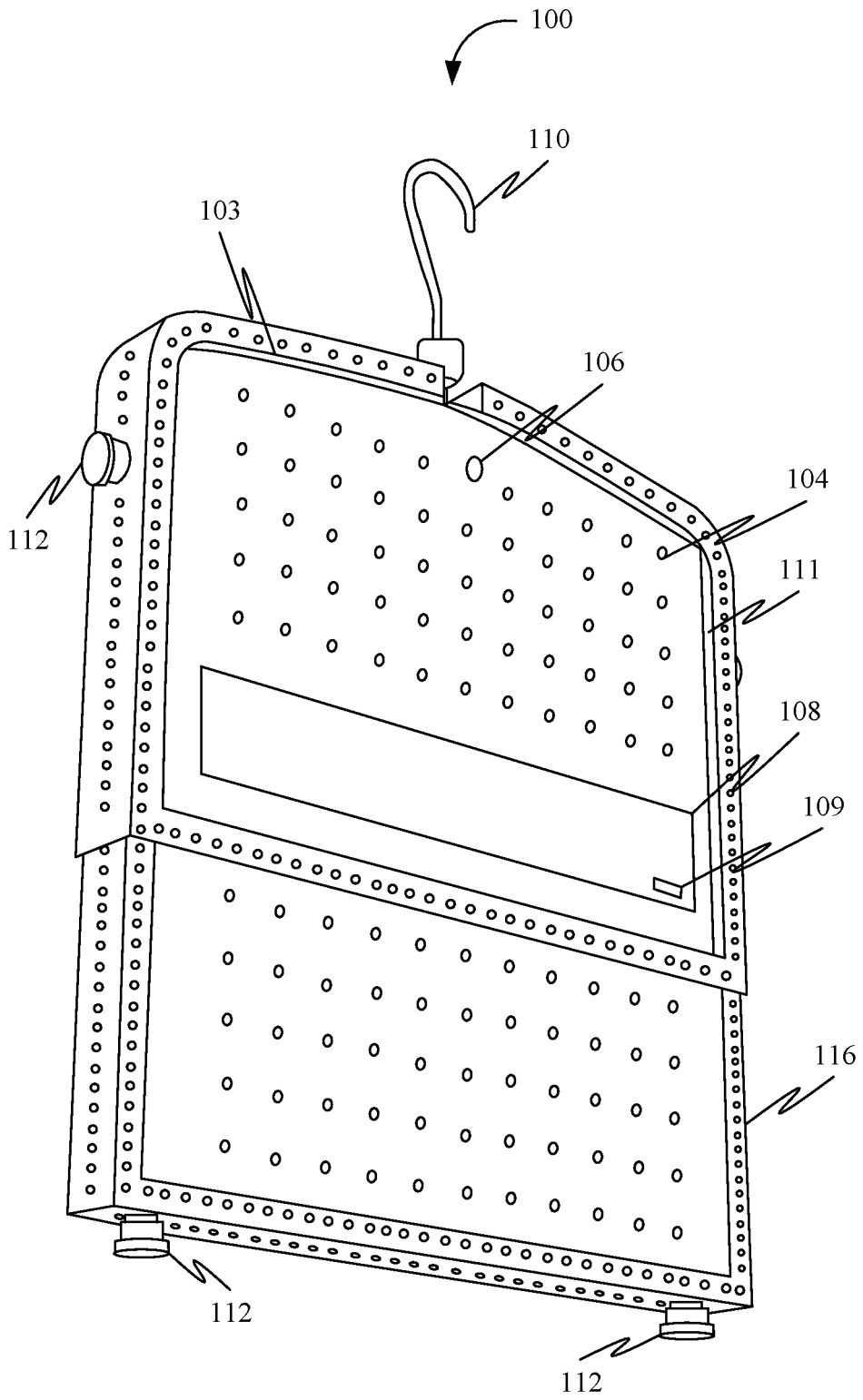
FIG. 9 is a bottom perspective view of a steam hanger with a retracting extension in an extended configuration, in accordance with some embodiments.
Figure 10:
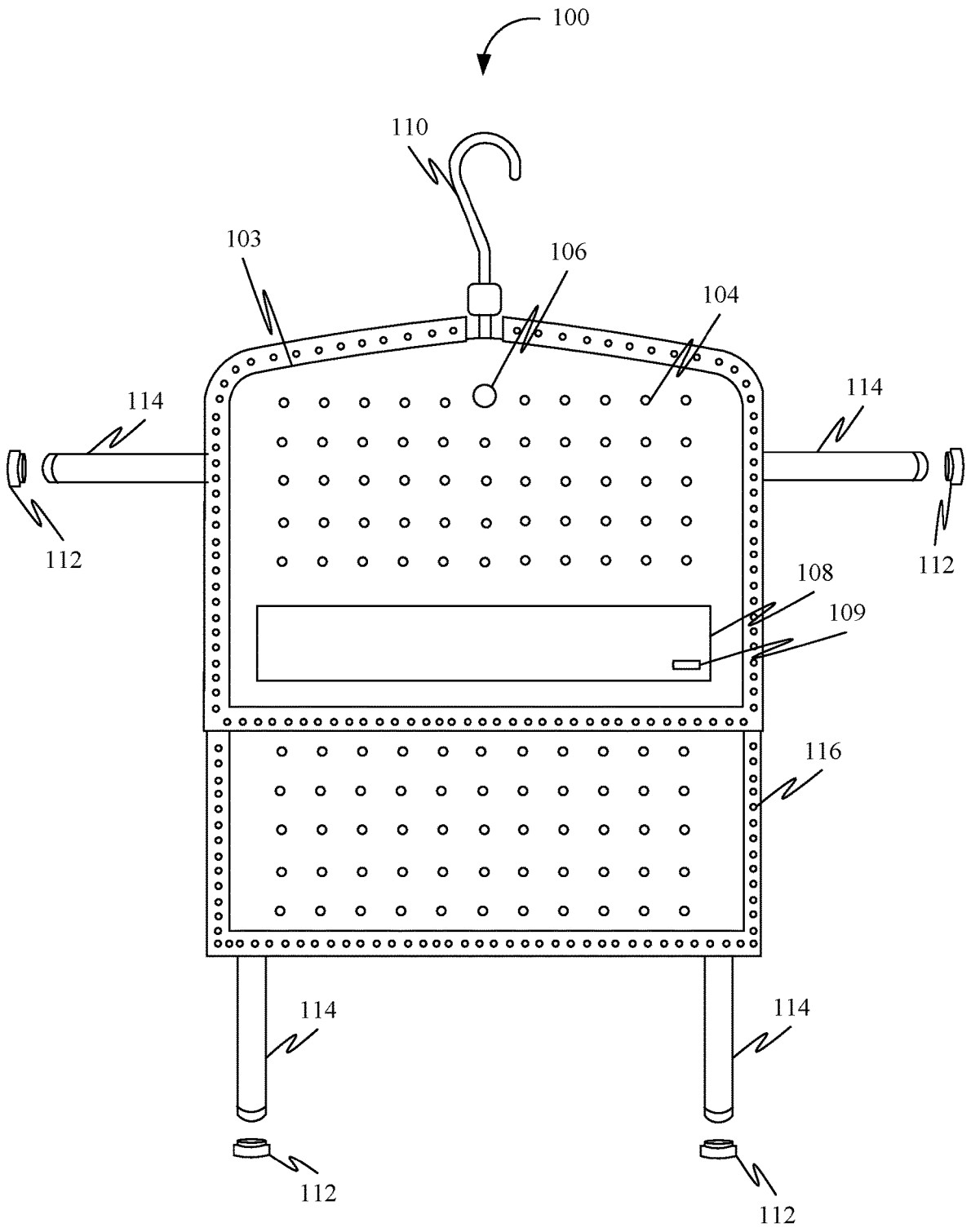
FIG. 10 is a front view of a steam hanger with retractable ducts in an extended configuration, in accordance with some embodiments.
Figure 11:
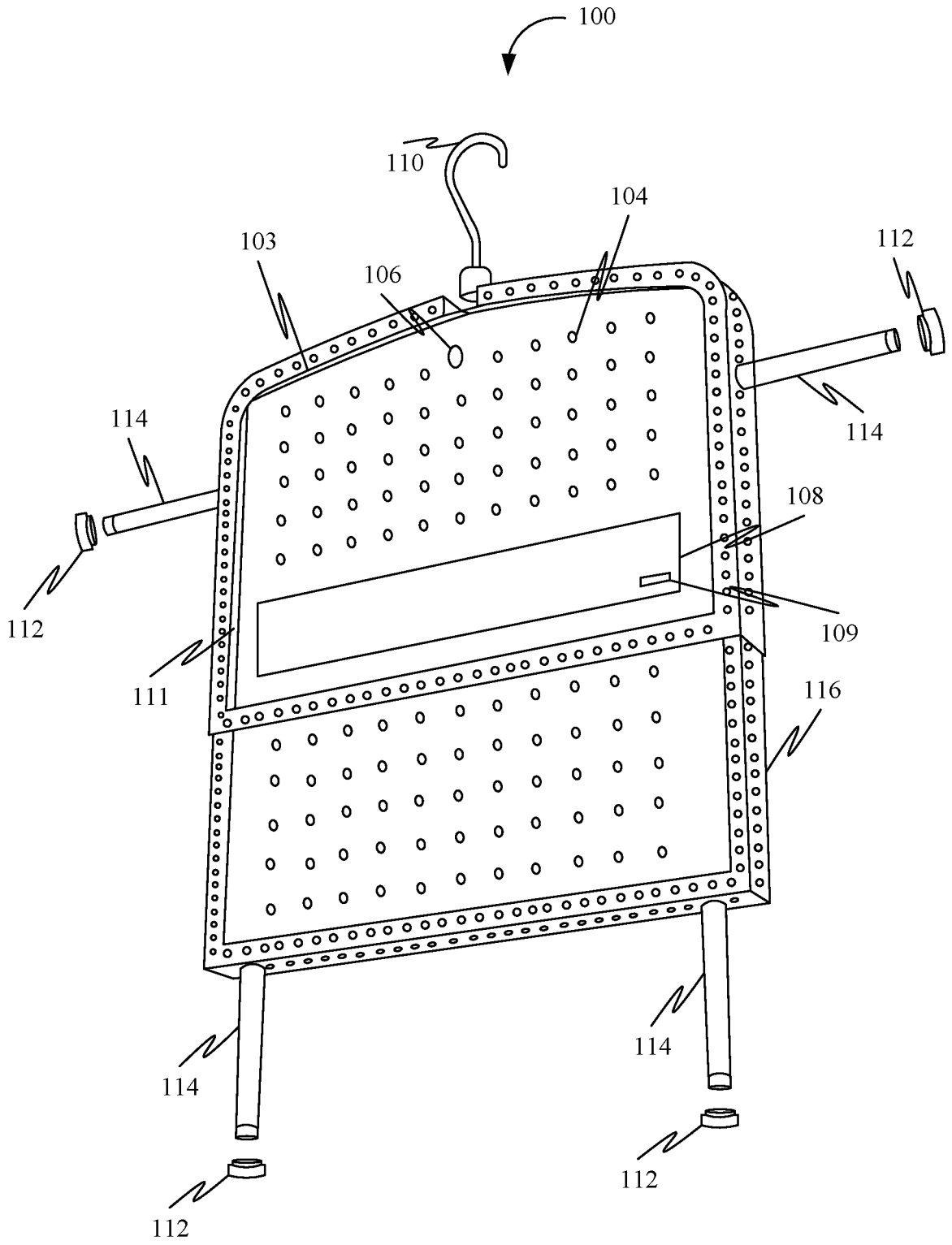
FIG. 11 is a bottom perspective view of a steam hanger with retractable ducts in an extended configuration, in accordance with some embodiments.

FIG. 2 is a left side view of the steam hanger 100, in accordance with some embodiments. Further, FIG. 3 is a rear view of the steam hanger 100. Further, FIG. 4 is a right side view of the steam hanger 100. Further, FIG. 5 is a front top perspective view of the steam hanger 100. Further, FIG. 6 is a rear top perspective view of the steam hanger 100. Further, FIG. 7 is a rear top perspective view of the steam hanger 100 with a foldable hook 110 in a folded configuration. Further, FIG. 8 is a front view of the steam hanger 100 with a retracting extension 116 in an extended configuration. Further, FIG. 9 is a bottom perspective view of the steam hanger 100 with a retracting extension 116 in an extended configuration. Further, FIG. 10 is a front view of the steam hanger 100 with retractable ducts 114 in an extended configuration. Further, FIG. 11 is a bottom perspective view of the steam hanger 100 with retractable ducts 114 in an extended configuration.

Further, in some embodiments, a steam hanger 100 may include a main body 102 having a substantially cuboid shape configured to support clothing. Further, at least one surface of the main body 102 may include a plurality of steam apertures 104 configured to release steam. Further, the main body 102 may include at least one fill spout 106. The at least one fill spout 106 may further include an opening to a water reservoir. Further, the at least one fill spout 106 may be configured to fill, and drain the water reservoir. Further, the main body 102 may include a foldable hook 110 attached to a top surface of the main body 102 configured to suspend the steam hanger 100 from a suspension point. Further, in some embodiments, the foldable hook 110 may be attached to the top surface through a rotating clamp 118. Further, the rotating clamp 118 may be configured to be rotated in order to fold the foldable hook.

Further, the steam hanger 100 may include the water reservoir including a flexible cylindrical tank 103 located inside the main body 102. Further, the flexible cylindrical tank 103 may be configured to store water. Further, in some embodiments, the water reservoir may be configured to be collapsed in an accordion-like manner.

Further, the steam hanger 100 may include a heating element 111 located inside the water reservoir configured to heat the water in the water reservoir to generate steam.

Further, the steam hanger 100 may include an energy storage device 108 electrically coupled with the heating element 111 through a controller 109. Further, in some embodiments, the controller 109 may be configured to allow the flow of electrical energy from the energy storage device 108 to the heating element 111 for a predetermined period. Further, the predetermined period may include at least one of 2 minutes, 3 minutes, and 15 minutes. Further, at least one of the energy storage device 108 and the controller 109 may be secured within the main body 102, Further the energy storage device 108 may be configured to provide electrical power to the heating element 111.

Further, the steam hanger 100 may include a plurality of retractable ducts 114 retractably attached to the at least one surface of the main body 102. Further, the plurality of retractable ducts 114 may be configured to extend in at least one direction to convey the steam outward for large sized clothing. Further, in some embodiments, two retractable ducts of the plurality of retractable ducts 114 may be located on side surfaces near an upper corner of the main body 102. Further, the two retractable ducts may be configured to extend laterally. Further, in some embodiments, two retractable ducts of the plurality of retractable ducts 114 may be located on a bottom surface near a lower corner of the main body 102. Further, the two retractable ducts may be configured to extend downward.

Further, the steam hanger 100 may include a retractable extension 116. Further, the retractable extension 116 may include a cuboid section substantially equal in size to the main body 102. Further, each surface of the retractable extension 116 may include the plurality of steam apertures 104. Further, the retractable extension 116 may be configured to be engaged with a bottom surface of the main body 102. Further, the retractable extension 116 may be extended from the bottom surface for distributing the steam to lower extremities of large sized clothing.

In some embodiments, a hanger (such as the steam hanger 100) may provide an internal water reservoir and a heating element 111 to generate steam. The heating element 111 may be powered by one or more large, high-capacity lithium ion batteries. To reduce costs, the design may be compatible with an existing battery design for a laptop computer. Each battery may be removable for recharging purposes. The hanger further may provide a plurality of steam apertures (such as the plurality of steam apertures 104) to release the steam, such that an article of clothing on the hanger may be gently steamed to remove wrinkles.

At the top center of the rear surface, the hanger may provide a fill spout (such as the fill spout 106). The fill spout may be used to fill the internal water reservoir with water, and drain the water from the internal water reservoir when preparing the hanger for transport or storage. The hanger further may provide a hook (such as the hook 110) which folds for transport and storage purposes, and a plurality of retractable ducts (such as the plurality of retractable ducts 114) which may convey steam outward into larger garments. Preferably, two of the ducts may be provided on the side surfaces near the upper corners of the hanger and extend laterally, and two more ducts may be provided on the bottom surface near the lower corners of the hanger and extend downward. Each duct may provide a removable endcap (such as the endcap 112), which may allow steam to be quickly vented when preparing the hanger for transport and storage.

The hanger further may provide a retracting extension (such as the retracting extension 116), preferably in various sizes, which may be extended from the lower surface of the hanger for the purpose of conveying and distributing steam to the lower extremities of longer garments, such as dresses with full-length skirts. The hanger utilizes the two lower ducts to convey steam into the extension for distribution. Additional extensions which may be separate items, and may be temporarily affixed to the bottom surface of the hanger, may be made available. Preferably, such additional extensions may be provided in a variety of sizes and shapes to accommodate different garments.

Further in some embodiments, the hanger may provide a timer function. This may enable the user to activate the heating element 111 for a predetermined period of the user's choice, such as 2 minutes, 3 minutes, or 15 minutes, and then automatically deactivate. This feature may conserve energy and water, and prevent the room, closet, or other space where the hanger may be used from becoming excessively humid for the user's comfort.

Further in some embodiments, the design of the hangar may be collapsible for space saving purposes. Such a design may incorporate a reservoir which may collapse in a manner similar to an accordion, and may include other design elements which support a compact size when the hanger may have collapsed.

In some embodiments, the user may fill the internal water reservoir with water and may activate the heating element 111. If desired for a larger or longer garment, the user may then extend some or all of the ducts as desired, or affix an extension to the bottom surface of the hanger. The user may then hang a garment on the hanger until any wrinkles on the garment may have been removed.

Further in some embodiments, the hanger, the battery, the hook, the ducts, and the extension may be preferably manufactured from rigid, durable materials which may be lightweight, heat resistant, corrosion resistant, and waterproof, such as aluminum alloy and stainless steel. The endcaps and the reservoir may be preferably manufactured from a semi-rigid, durable material which may be waterproof, such as plastic.

Components, component sizes, and materials listed above are preferable, but artisans will recognize that alternate components and materials could be selected without altering the scope of the disclosure.

While the foregoing written description of the disclosure enables one of ordinary skill to make and use what may be presently considered to be the best mode thereof, those of ordinary skill in the art will understand and appreciate the existence of variations, combinations, and equivalents of the specific embodiment, method, and examples herein. The disclosure should, therefore, not be limited by the above-described embodiment, method, and examples, but by all embodiments and methods within the scope and spirit of the disclosure.

Although the disclosure has been explained in relation to its preferred embodiment, it is to be understood that many other possible modifications and variations can be made without departing from the spirit and scope of the disclosure.

What is claimed is:

1. A steam hanger comprising:

a main body having a substantially cuboid shape configured to support clothing, wherein at least one surface of the main body comprises a plurality of steam apertures configured to release steam, wherein the main body further comprises:

at least one fill spout comprising an opening to a water reservoir, wherein the at least one fill spout is configured to fill, and drain the water reservoir; and, a foldable hook attached to a top surface of the main body configured to suspend the steam hanger from a suspension point;

the water reservoir comprising a flexible cylindrical tank located inside the main body, wherein the flexible cylindrical tank is configured to store water;

a heating element located inside the water reservoir configured to heat the water in the water reservoir to generate the steam;

an energy storage device electrically coupled with the heating element through a controller, wherein at least one of the energy storage device and the controller are secured within the main body, wherein the energy storage device is configured to provide electrical power to the heating element; and, a plurality of retractable ducts retractably attached to the at least one surface of the main body, wherein the plurality of retractable ducts is configured to extend in at least one direction to convey the steam outward for large sized clothing, wherein two retractable ducts of the plurality of retractable ducts are located on a bottom surface near a lower corner of the main body, where the two retractable ducts are configured to extend downward.

2. The steam hanger of claim 1, wherein the energy storage device comprises at least one of a Lithium-ion battery, a Nickel-Cadmium battery, a Lead-Acid battery, and a Nickel-Metal hydride battery.

3. The steam hanger of claim 1, wherein the energy storage device is removably secured within the main body.

4. The steam hanger of claim 1, wherein the at least one fill spout is located at a top center of a rear surface of the main body.

5. The steam hanger of claim 1, wherein the foldable hook is attached to the top surface through a rotating clamp, wherein the rotating clamp is configured to be rotated in order to fold the foldable hook.

6. The steam hanger of claim 1, wherein each retractable duct in the plurality of retractable ducts comprises a removable endcap, wherein the removable endcap is configured to allow the steam to be quickly vented when the removable endcap is removed from the retractable duct.

7. The steam hanger of claim 1, wherein two retractable ducts of the plurality of retractable ducts are located on side surfaces near an upper corner of the main body, wherein the two retractable ducts are configured to extend laterally.

8. The steam hanger of claim 1 further comprising a retractable extension, wherein the retractable extension is a cuboid section substantially equal in size to the main body, wherein each surface of the retractable extension comprises the plurality of steam apertures.

9. The steam hanger of claim 8, wherein the retractable extension is configured to be engaged with a bottom surface of the main body, wherein the retractable extension is extended from the bottom surface for distributing the steam to lower extremities of large sized clothing.

10. The steam hanger of claim 1, wherein the controller is configured to allow the flow of electrical energy from the energy storage device to the heating element for a predetermined period.

11. The steam hanger of claim 8, wherein at least one of the main body, the foldable hook, the plurality of ducts, and the retractable extension is manufactured using at least one of a stainless steel, and an aluminum alloy.

12. The steam hanger of claim 6, wherein at least one of the removable endcap, and the water reservoir is manufactured using at least one of a plastic, and a rubber.

13. A steam hanger comprising:

a main body having a substantially cuboid shape configured to support clothing, wherein at least one surface of the main body comprises a plurality of steam apertures configured to release steam, wherein the main body further comprises:

at least one fill spout comprising an opening to a water reservoir, wherein the at least one fill spout is configured to fill, and drain the water reservoir; and, a foldable hook attached to a top surface of the main body configured to suspend the steam hanger from a suspension point;

the water reservoir comprising a flexible cylindrical tank located inside the main body, wherein the flexible cylindrical tank is configured to store water;

a heating element located inside the water reservoir configured to heat the water in the water reservoir to generate steam;

an energy storage device electrically coupled with the heating element through a controller, wherein at least one of the energy storage device and the controller are secured within the main body, wherein the energy storage device is configured to provide electrical power to the heating element;

a plurality of retractable ducts retractably attached to the at least one surface of the main body, wherein the plurality of retractable ducts is configured to extend in at least one direction to convey the steam outward for large sized clothing; and a retractable extension comprising a cuboid section substantially equal in size to the main body, wherein each surface of the retractable extension comprises the plurality of steam apertures, wherein the retractable extension is configured to be engaged with a bottom surface of the main body, wherein the retractable extension is extended from the bottom surface for distributing the steam to lower extremities of large sized clothing.

14. The steam hanger of claim 13, wherein the controller is configured to allow the flow of electrical energy from the energy storage device to the heating element for a predetermined period.

15. The steam hanger of claim 13, wherein two retractable ducts of the plurality of retractable ducts are located on side surfaces near an upper corner of the main body, wherein the two retractable ducts are configured to extend laterally.

16. The steam hanger of claim 13, wherein two retractable ducts of the plurality of retractable ducts are located on a bottom surface near a lower corner of the main body, wherein the two retractable ducts are configured to extend downward.

17. The steam hanger of claim 13, wherein the foldable hook is attached to the top surface through a rotating clamp, wherein the rotating clamp is configured to be rotated in order to fold the foldable hook.

* * * * *